US006596034B1

(12) United States Patent
Crawford et al.

(10) Patent No.: US 6,596,034 B1
(45) Date of Patent: Jul. 22, 2003

(54) TEXTILE MATERIAL

(75) Inventors: Robert John Crawford, Wirral (GB); David Duncan, Bracknell (GB); Dax Kukulj, Wirral (GB); Philip John Sams, Wirral (GB)

(73) Assignee: Unilever Home and Personal Care USA division of Conopco, Inc., Greenwich, CT (US)

( * ) Notice: Subject to any disclaimer, the term of this patent is extended or adjusted under 35 U.S.C. 154(b) by 253 days.

(21) Appl. No.: 09/722,972

(22) Filed: Nov. 27, 2000

(30) Foreign Application Priority Data

Nov. 25, 1999 (GB) ..... 9927903

(51) Int. Cl.[7] ..... D06M 13/17
(52) U.S. Cl. ..... 8/115.6; 8/137; 510/276
(58) Field of Search ..... 8/115.6, 137; 510/276

(56) References Cited

U.S. PATENT DOCUMENTS 5,164,231 A 11/1992 Davis ..... 427/256
5,534,182 A * 7/1996 Kirk et al. ..... 8/137

FOREIGN PATENT DOCUMENTS

EP 0 300 525 1/1989
GB 494 466 10/1938
GB 939256 10/1963
GB 1 062 422 3/1967
GB 1274747 5/1972
WO 96/15309 5/1996
WO 96/15310 5/1996

OTHER PUBLICATIONS

International Search Report PCT/EP/00–10896 May 31, 2001–3pp.

WPI Abstract Acc. No. 1991–135488 [25] JP 03069678 A (High Sheet Kogyo et al.)—1p.

WPI Abstract 1990JP–0157752/19900618 (Abstract of JP04050234 A (ASAH).

Rawls et al "Journal of Applied Polymer Science" vol. 15, pp. 341–349 (1971).

* cited by examiner

*Primary Examiner*—Charles Boyer
*Assistant Examiner*—Eisa Elhilo
(74) *Attorney, Agent, or Firm*—Alan A. Bornstein

(57) ABSTRACT

The treatment of fabric by coating with from 0.01 to 2% by weight on weight of fabric of a polymer composition comprising a thermoplastic elastomer improves the crease recovery properties and/or elasticity and/or tensile strength of a fabric.

12 Claims, 1 Drawing Sheet

TEXTILE MATERIAL

Figure 1:
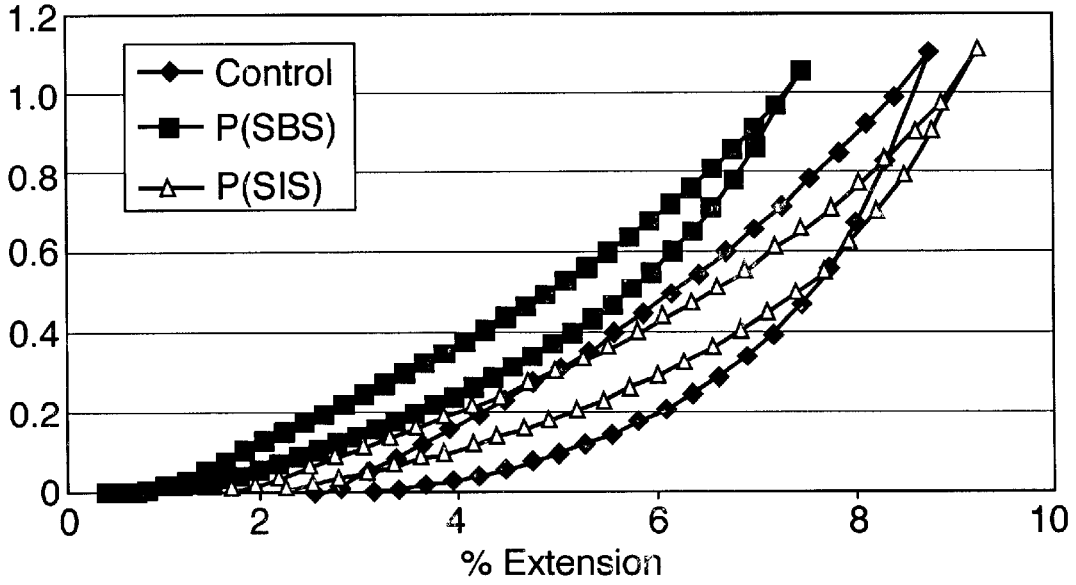

This invention relates to textile material, to methods of treating fabric in order to obtain the textile material, to the use of thermoplastic elastomers for improving the crease recovery properties and/or elasticity of a fabric and to fabric care compositions, which comprise a thermoplastic elastomer.

The creasing of fabrics is an almost inevitable consequence of cleaning fabrics, such as in a domestic laundering process. Fabrics also become creased in wear. Creasing can be a particular problem for fabrics, which contain cellulosic fibres such as cotton, because the creasing is often difficult to remove. Generally, the creases, which are developed in a fabric during laundering, are removed by ironing. However, because ironing is seen as a time consuming chore, there is an increasing trend for fabrics to be designed such that the need for ironing is reduced and/or the effort required for ironing is lower.

Compositions for reducing the wrinkling of fabric are described in WO 96/15309 and WO 96/15310. The compositions contain a silicone and a film-forming polymer and it appears that it is the lubricating effect of the silicone, which is responsible for their anti-wrinkle properties. This conclusion is supported by the fact that a wide variety of polymers is mentioned as being suitable for use in the compositions.

Industrial treatments of fabrics to reduce their tendency to crease are known. JP-A-04-50234 describes a textile treatment in which the crease resistance of a plain weave cotton fabric is increased by applying a so-called "shape memory resin" to the fabric. However, this document teaches that the resin is applied to the fabric at a relatively high amount of 10% by weight on weight of fabric and it is not clear how this level of resin affects other properties of the fabric. Furthermore, treatment of the fabric with the resins is followed by a step of drying at 80° C. and the shape memory function is described as being heat-sensitive, with deformations at normal temperatures being restored to the original shape on heating at a specific temperature.

A relationship between polymer elastic properties and the ability to impart improved wrinkle recovery to cotton fabric is described by Rawls et al in Journal of Applied Polymer Science, vol. 15, pages 341–349 (1971). A variety of different elastomers was applied to fabric and, particularly in the few cases where thermoplastic elastomers were used, the polymers were applied to the fabric at the relatively high levels of 4% and above. There is no indication that any benefit would be obtained in applying polymers to the fabric at lower levels and no suggestion as to practical applications of the technique.

The treatment of fabrics with cross-linking agents in order to impart antiwrinkle properties is known. Compounds such as formaldehyde-based polymers, DMDHEU (dimethylol dihydroxy ethylene urea) and BTCA (butyl-1, 2,3,4-tetracarboxylic acid) may be used as the cross-linking agent. However, these treatments have the disadvantage of reducing the tensile strength of the fabrics.

The present invention aims to reduce the tendency for fabrics to become wrinkled or creased.

The invention further aims to reduce the deleterious effects on elasticity and tensile strength of fabrics, which some conventional anti-wrinkle treatments impart. The invention may also provide a degree of shape retention in the fabric.

According to the present invention, there is provided textile material comprising a fabric coated with 0.01% to 2% by weight on weight of fabric of a polymer composition comprising a thermoplastic elastomer. Coating the fabric with a thermoplastic elastomer can improve both the crease recovery properties and the elasticity of the fabric.

Therefore, in another aspect, the invention provides a process for treating fabric, which comprises coating the fabric with from 0.01% to 2% by weight on weight of fabric of a polymer composition comprising a thermoplastic elastomer. Also provided by the invention is the use of a thermoplastic elastomer at these levels to improve the crease recovery properties and/or elasticity and/or the tensile strength of a fabric.

In a further aspect, the invention provides the use of a thermoplastic elastomer to improve the surface colour definition of a fabric following multiple washings.

Further provided by the invention are a fabric care composition comprising a solution, dispersion or emulsion comprising a thermoplastic elastomer and a textile compatible carrier and a method of treating fabric comprising treating the fabric with a fabric care composition of the invention as part of a laundering process. The laundering process may be a large scale or small-scale (e.g. domestic) process. When the laundering process is a domestic process, the composition may be packaged and labelled for this use.

Preferably, the textile material of the invention is suitable for use in a garment or is part or all of a garment itself. The fabric may be woven or knitted (both of which terms are intended to be covered by the generic term "textile material", as used herein) and preferably comprises a cellulosic fibre, such as cotton eg, in an amount of 50% to 100%, such as 75% to 100% for example. If the fabric contains less than 100% cellulosic fibres, the balance may be of any natural or synthetic fibres or a mixture thereof, such as polyamide or polyester, for example.

The polymer composition comprises a thermoplastic elastomer. The composition may contain other components, for example other polymers which impart benefits to the fabric when it is used in a garment. The composition may be substantially free of lubricating polymers such as silicones.

The thermoplastic elastomer is desirably non-crosslinked and is preferably a block copolymer. The elastomer can be linear, branched, and radial or star shaped in topology but is preferably linear. More preferably, the elastomer comprises at least two hard blocks linked by one soft block (eg, an ABA block copolymer). The hard blocks are of a material that, on its own (i.e., as a single polymer), is hard at room temperature but becomes fluid on heating. The soft blocks comprise a softer material that, on its own, is rubber-like at room temperature. Preferably, the percentage by weight of the hard blocks in the polymer is from 2 to 98%, more preferably from 5 to 95%, most preferably from 10 to 90%.

Conveniently, the polymers have a molecular weight of from 1,000 to 2,000,000, preferably from 2,000 to 1,000,000 and most preferably from 3,000 to 500,000.

The hard blocks of the thermoplastic elastomer preferably comprise aromatic rings, optionally substituted. Thus, the hard blocks may be, for example, polymers or copolymers of styrene or of derivatives of styrene. Alternative hard blocks include, for example, polymers and copolymers comprising poly(methyl methacrylate).

The soft blocks are conveniently polymers or copolymers of branched or unbranched $C_2$ to $C_6$ alkenes, $C_4$ to $C_8$ alkadienes, $C_2$ to $C_6$ alkylene diols or $C_2$ to $C_8$ alkylene oxides. Preferably, the soft blocks are polymers or copolymers of ethene, propene, butane, butadiene (cis or trans) or isoprene (cis or trans). If the soft block is a polymer or copolymer of butadiene or isoprene, the butadiene or isoprene residues may be fully or partially hydrogenated.

Suitable thermoplastic elastomers include block copolymers of styrene-isoprene-styrene; styrene-butadiene-styrene, styrene-ethylene/butadiene-styrene, styrene-ethylene-styrene, styrene-ethylene/propylene-styrene, styrene-propylene-styrene and styrene-butylene-styrene and block polymers selected from polyurethane's, polyesters, polyamides and polypropylene/ethylene-propylene.

In the present invention, the thermoplastic elastomer is applied to the fabric such that from 0.01% to 2% by weight on weight of fabric of the thermoplastic elastomer is coated onto the fabric. Advantageously, lower levels of thermoplastic elastomer can be applied eg, from 0.01% to 1.5% preferably 0.01% to 1%, more preferably 0.1% to 1%. Generally, the thermoplastic elastomer will at least partially coat individual fibres. At these levels of application, the physical properties of the fabric which make it suitable for use in a garment are retained (ie, the overall feel and appearance of the fabric remains substantially unchanged) but, unexpectedly, the fabric has improved crease recovery properties.

The crease recovery properties of a fabric treated according to the present invention are improved relative to fabric not so treated. Treatment of the fabric typically reduces the tendency of the fabric to remain creased. Thus, following treatment according to the invention, the crease recovery angle, which is a measure of the degree to which a fabric returns to its original shape following creasing, increases. The fabric may still require a degree of treatment (eg, by ironing) to reduce its creasing after washing and drying in a conventional domestic laundering process. However, the amount of crease reduction by ironing required for fabric treated according to the invention will typically be less than that required by untreated fabric. It will be appreciated that any reduction in the amount of crease reduction, such as ironing, which is required, is beneficial.

The process of the invention preferably comprises the step of applying a solution (in a suitable solvent such as an organic solvent, for instance, eg, toluene or THF) or an emulsion of the thermoplastic elastomer to the fabric. The solution may be applied to the fabric by conventional methods such as dipping, spraying or soaking, for example.

The fabric care composition of the invention comprises a solution, dispersion or emulsion comprising a thermoplastic elastomer and a textile compatible carrier. The textile compatible carrier facilitates contact between the fabric and the thermoplastic elastomer. The textile compatible carrier may be water or a surfactant, however when it is water perfume must be present. In a composition that is used during the washing or rinse cycles of a washing machine, it is highly preferable if the textile compatible carrier is a cationic surfactant, more preferably a cationic softening agent.

If the fabric care composition of the invention is in the form of a dispersion or emulsion of the thermoplastic elastomer or if, in the process of the invention, a dispersion or emulsion of the thermoplastic elastomer is used, the fabric treated with the composition may need to be heated to a temperature above the Tg of the hard blocks of the elastomer in order to obtain the advantages of the invention. The heating of the treated fabric can be carried out as a separate heating step or may form part of the laundering process eg taking place during drying of the fabric (for example in a tumble dryer) or, more preferably, during ironing of the fabric. Alternatively, a plasticiser or coalescing agent may be used to lower the Tg of the thermoplastic elastomer in order to avoid the need for heating or to reduce the temperature of the heating step required to obtain the advantages of the invention.

The process of the invention may be carried out as a treatment of the fabric before or after it has been made into garments, as part of an industrial textile treatment process. Alternatively, it may be provided as a spray composition eg, for domestic (or industrial) application to fabric in a treatment separate from a conventional domestic laundering process.

Alternatively, in the method of the invention, the treatment is carried out as part of a laundering process. Suitable laundering processes include large scale and small-scale (eg domestic) processes. Such a process may involve the use of a fabric care composition of the invention, for example. The fabric care composition of the invention may be a main wash detergent composition, in which case the textile compatible carrier may be a detergent and the composition may contain other additives, which are conventional in main wash detergent compositions. Alternatively, and preferably, the fabric care composition may be adapted for use in the rinse cycle of a domestic laundering process, such as a fabric conditioning composition or an adjunct, and the textile compatible carrier may be a fabric conditioning compound (such as a quaternary alkylammonium compound) or simply water, and conventional additives such as perfume may be present in the composition.

It is advantageous in compositions for use in a domestic setting to further comprise a plasticiser. In the context of this invention on plasticiser is any material that can modify the flow properties of the thermoplastic elastomer. Suitable plasticisers include $C_{12}$–$C_{20}$ alcohols, glycol ethers, phthalates and automatic hydrocarbons. It is also highly advantageous, if the compositions comprise a perfume.

Detergent Active Compounds

If the fabric care composition of the present invention is in the form of a detergent composition, the textile-compatible carrier may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred textile-compatible carriers that can be used are soaps and synthetic non-soap anionic and nonionic compounds.

Anionic surfactants are well known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $RR_2R_3R_4N^+ X^-$ wherein the R groups are independently hydrocarbyl chains of $C_1$–$C_{22}$ length, typically alkyl, hydroxyalkyl or ethoxylated alkyl groups, and X is a solubilising cation (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters) and pyridinium salts.

The total quantity of detergent surfactant in the composition is suitably from 0.1 to 60 wt % e.g. 0.5–55 wt %, such as 5–50 wt %.

Preferably, the quantity of anionic surfactant (when present) is in the range of from 1 to 50% by weight of the total composition. More preferably, the quantity of anionic surfactant is in the range of from 3 to 35% by weight, e.g. 5 to 30% by weight.

Preferably, the quantity of nonionic surfactant when present is in the range of from 2 to 25% by weight, more preferably from 5 to 20% by weight.

Amphoteric surfactants may also be used, for example amine oxides or betaines.

The compositions may suitably contain from 10 to 70%, preferably from 15 to 70% by weight, of detergency builder. Preferably, the quantity of builder is in the range of from 15 to 50% by weight.

The detergent composition may contain as builder a crystalline aluminosilicate, preferably an alkali metal aluminosilicate, more preferably a sodium aluminosilicate.

The aluminosilicate may generally be incorporated in amounts of from 10 to 70% by weight (anhydrous basis), preferably from 25 to 50%. Aluminosilicates are materials having the general formula:

$$0.8\text{–}1.5M_2O.Al2O3.\ 0.8\text{–}6\ SiO_2$$

where M is a monovalent cation, preferably sodium. These materials contain some bound water and are required to have a calcium ion exchange capacity of at least 50 mg CaO/g. The preferred sodium aluminosilicates contain 1.5–3.5 $SiO_2$ units in the formula above. They can be prepared readily by reaction between sodium silicate and sodium aluminate, as amply described in the literature.

Fabric Softening and/or Conditioner Compounds

If the fabric care composition of the present invention is in the form of a fabric conditioner composition, the textile-compatible carrier will be a fabric softening and/or conditioning compound (hereinafter referred to as "fabric softening compound"), which may be a cationic or nonionic compound.

The softening and/or conditioning compounds may be water insoluble quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

Compositions suitable for delivery during the rinse cycle may also be delivered to the fabric in the tumble dryer if used in a suitable form. Thus, another product form is a composition (for example, a paste) suitable for coating onto, and delivery from, a substrate e.g. a flexible sheet or sponge or a suitable dispenser during a tumble dryer cycle.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric-softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The fabric softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337).

Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12\text{-}22}$ alkyl or alkenyl groups connected to the molecule via at least one ester link, preferably two ester links. An especially preferred ester-linked quaternary ammonium material can be represented by the formula II:

(II)

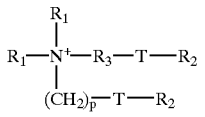

wherein each Ri group is independently selected from $C_{1\text{-}4}$ alkyl or hydroxyalkyl groups or $C_{2\text{-}4}$ alkenyl groups; each $R_2$group is independently selected from $C_{8\text{-}28}$ alkyl or alkenyl groups; and wherein $R_3$ is a linear or branched alkylene group of 1 to 5 carbon atoms, T is

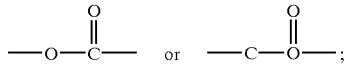

and p is 0 or is an integer from 1 to 5.

Di(tallowoxyloxyethyl) dimethyl ammonium chloride and/or its hardened tallow analogue is especially preferred of the compounds of formula (II).

A second preferred type of quaternary ammonium material can be resented by the formula (III):

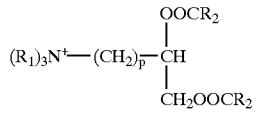

(III)

wherein $R_1$, p and $R_2$ are as defined above.

It is advantageous if the quaternary ammonium material is biologically biodegradable.

Preferred materials of this class such as 1,2-bis(hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may comprise a cationic fabric softening compound and an oil, for example as disclosed in EP-A-0829531.

The compositions may alternatively or additionally contain nonionic fabric softening agents such as lanolin and derivatives thereof.

Lecithins are also suitable softening compounds.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

The fabric conditioning compositions may include silicones, such as predominately linear polydialkylsiloxanes, e.g. polydimethylsiloxanes or aminosilicones containing amine-functionalised side chains; soil release polymers such as block copolymers of polyethylene oxide and terephthalate; amphoteric surfactants; smectite type inorganic clays; zwitterionic quaternary ammonium compounds; and nonionic surfactants.

The fabric conditioning compositions may also include an agent, which produces a pearlescent appearance, e.g. an organic pearlising compound such as ethylene glycol distearate, or inorganic pearlising pigments such as microfine mica or titanium dioxide ($TiO_2$) coated mica.

The fabric conditioning compositions may be in the form of emulsions or emulsion precursors thereof.

Other optional ingredients include emulsifiers, electrolytes (for example, sodium chloride or calcium chloride) preferably in the range from 0.01 to 5% by weight, pH buffering agents, and perfumes (preferably from 0. 1 to 5% by weight).

Further optional ingredients include non-aqueous solvents, perfume carriers, fluorescers, colourants, hydrotropes, antifoaming agents, antiredeposition agents, enzymes, optical brightening agents, opacifiers, dye transfer inhibitors, anti-shrinking agents, anti-wrinkle agents, anti-spotting agents, germicides, fungicides, anti-oxidants, UV absorbers (sunscreens), heavy metal sequestrants, chlorine scavengers, dye fixatives, anti-corrosion agents, drape imparting agents, antistatic agents and ironing aids. This list is not intended to be exhaustive.

Fabric Treatment Products

The fabric care composition of the invention may be in the form of a liquid, solid (e.g. powder or tablet), a gel or paste, spray, stick or a foam or mousse. Examples including a soaking product, a rinse treatment (e.g. conditioner or finisher) or a mainwash product. The composition may also be applied to a substrate e.g. a flexible sheet or used in a dispenser which can be used in the wash cycle, rinse cycle or during the dryer cycle.

The present invention has the advantage not only of increasing the crease recovery angle of fabric but also of improving the tensile strength of the fabric. The tensile strength of fabrics has in the past been increased by, for example, including fibres of a thermoplastic elastomer, such as Lycra (trade mark) yarns, in the fabric itself. It was unexpected that coating the fibres with a thermoplastic elastomer, according to the invention, could provide improved crease resistance and increased tensile strength. The effect was particularly surprising because a number of conventional treatments for improving the crease resistance of fabrics can have the opposite effect of reducing the tensile strength of the fabric, particularly where the treatment involves cross-linking of the fabric.

Fabric treated according to the invention also has the advantage of improved surface colour definition following multiple washings. Thus, the overall appearance of the fabric following multiple washings may be improved. Without wishing to be bound by theory, it is believed that this colour care benefit may be due to a reduced tendency for fibres in the treated fabric to fibrillate.

It is preferable if after application compositions according to the invention a curing process takes place such as ironing or tumble drying.

Figure 2:
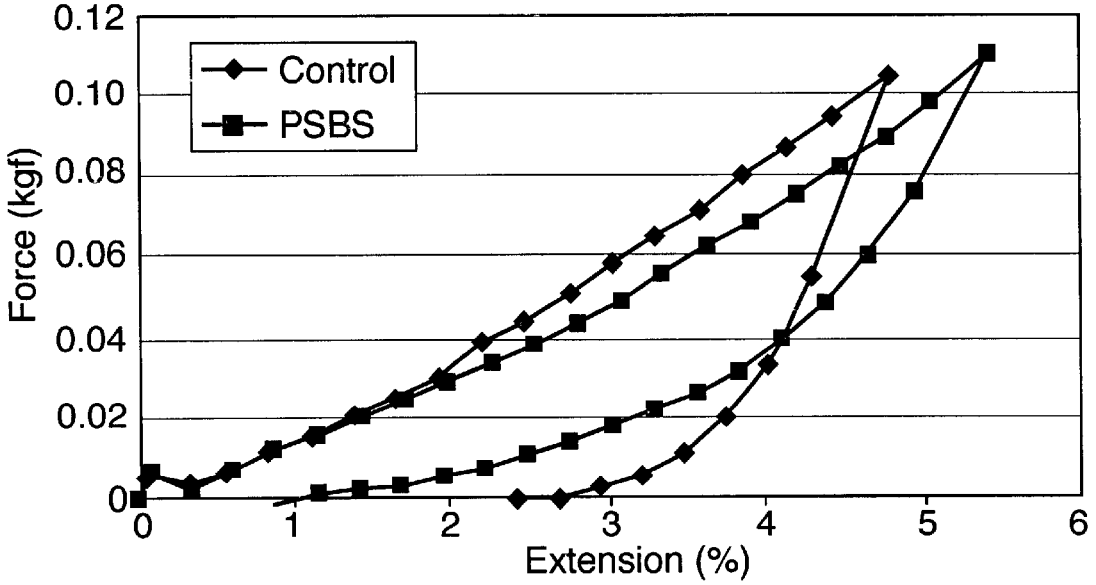

In the accompanying drawings, which are presented for illustrative purposes only:

FIG. 1 shows the effect of two different thermoplastic elastomers-poly (styrene-butadiene-styrene) (PSBS) and poly (styrene-isoprene-styrene) (PSIS)-on the force versus extension showing the hysteresis when woven cotton fabric treated according to the invention at 1% owf is stretched and relaxed; and FIG. 2 shows the results of repeating the test of FIG. 1 using knitted cotton fabric according to the invention.

The following non-limiting examples illustrate the invention.

EXAMPLES

Experimental Procedure

Each thermoplastic elastomer (polymer) was dissolved in toluene or tetrahydrofuran to give the desired polymer solution concentration. Prewashed woven cotton sheeting was weighed and placed into a beaker containing the polymer solution and stirred for 10 min to ensure penetration of the solvent into the cotton sheeting. The cotton sheets were then removed, the excess solvent allowed to drain, weighed, and air dried. From the weight of fabric before and after dipping in the solution, it is possible to calculate the percentage of polymer that is on the fabric. The dried sheets were ironed and then conditioned at 65% relative humidity and 20 ° C. for at least 24 hours. This method of treatment was employed in all except Example 22.

Crease recovery angles were measured using a "Shirley crease recovery angle tester" based on AATC Test Method 66–1990. 50 mm×25 mm samples were prepared, folded in half and placed under a 1 kg load for 60 s. The angle that the sample opened up to after 60 s was measured. Six measurements were performed in both the warp and weft directions on the fabric and averaged. The crease recovery angle was determined from the sum of the average warp and weft values.

The wing rip tear strength was measured according to BS 4303:1968.

The elastic recovery was compared from the hysteresis in the Force vs Elongation graph observed using a Testometric (trade mark) tester when a sample is stretched and relaxed.

Sample size: 170 mm×80 mm

Area of stretching: 100 mm×25 mm

Elongation Rate: 100 mm·min$^{-1}$

Measurement: Apply 1.0 kg force and relax to 0.0 kg force

Examples 1–13

Table 1 shows the effect of crease recovery angle (CRA) and tensile strength of the fabric before (control) and after treatment with 1% polymer.

TABLE 1

Results of Crease Recovery angle and Tensile Strength with 1% polymer on weight of fabric.

| Example | Polymer (1% owf) | CRA (°)[a] | nsile Strength (kgf)[b] |
|---|---|---|---|
| Control | | 130 | 1.22 |
| 1 | P(SIS) | 178 | 1.31 |
| 2 | P(SBS) | 167 | 1.29 |
| 3 | Kraton D ™ 1102 CS | 174 | 1.42 |

TABLE 1-continued

Results of Crease Recovery angle and Tensile Strength with 1% polymer on weight of fabric.

| Example | Polymer (1% owf) | CRA (°)[a] | nsile Strength (kgf)[b] |
|---|---|---|---|
| 4 | 1161 NS | 176 | 1.43 |
| 5 | 1186 CS | 179 | 1.25 |
| 6 | 1101 CS | 174 | 1.49 |
| 7 | Kraton G ™ 1650 E | 155 | 1.22 |
| 8 | 1726 X | 151 | 1.26 |
| 9 | 1702 X | 157 | 1.38 |
| 10 | 1701 E | 150 | 1.21 |
| 11 | Kraton G ™ 1901 X | 156 | 1.34 |
| 12 | 1901 X2 | 167 | 1.38 |
| 13 | 1901X(CAT) | 163 | 1.33 |

[a]Crease recovery angle determined using Shirley crease recovery angle tester (sum of warp and weft values)
[b]Determined using Wing Rip Tear Test BS 4303:1968.

Kraton D,G and FG (trade marks) polymers are thermoplastic elastomers obtained from Shell UK. P(SIS) and P(SBS) were obtained from Aldrich Chemical Co. Ltd.

Example 14

The experiment using P(SIS) was repeated using different levels of polymer on the fabric.

Table 2 shows the dependence of the crease recovery angle, CRA, on the level of poly(styrene-isoprene-styrene), PSIS, applied to the fabric.

TABLE 2

Dependence of CRA on level of PSIS

| PSIS (% owf) | CRA (°) |
|---|---|
| 0 | 146 |
| 0.5 | 184 |
| 1 | 197 |
| 2 | 202 |

Example 15

The procedure of Example 14 was repeated using PSBS in place of PSIS. The tensile strength of the treated fabric was also determined as described above. The results are given in Table 3. A different batch of fabric was used from that used in Example 14 and this gave rise to a different CRA for the untreated fabric.

TABLE 3

Dependence of CRA and Tensile Strength on level of PSBS

| PSBS (% owf) | CRA (°) | Tensile Strength (Kgf) |
|---|---|---|
| 0 | 135 | 1.24 |
| 0.1 | 157 | 1.28 |
| 0.25 | 160 | 1.36 |
| 0.5 | 174 | 1.45 |
| 1 | 190 | 1.63 |

Table 3 shows that improvements in CRA and tensile strength can be obtained at 0.1% owf using PSBS as the thermoplastic elastomer.

There is a significant increase in CRA at low levels (0.1%) and the value continues to increase as more polymer is applied.

Example 16

An investigation was carried out on the elastic recovery of fabric treated with the polymers.

FIG. 1 shows the effect of poly(styrene-butadiene-styrene), PSBS, and poly(styrene-isoprene-styrene), PSIS, on the force vs extension showing the hysteresis when the fabric is stretched and relaxed in the warp direction. Both polymers are at 2% owf. It is apparent that the area in the hysteresis loop is reduced when the polymer is applied as compared to the control. This corresponds to an increase in the elastic recovery of the sample.

Table 4 quantifies the difference in hysteresis area shown in FIG. 1 by showing the area inside the loop.

TABLE 4

Areas of the hysteresis loops of FIG. 1

| Sample | Area |
|---|---|
| Control | 1.09 |
| P(SBS) | 0.55 |
| P(SIS) | 0.68 |

The area of the poly(styrene-butadiene-styrene), PSBS, and poly(styrene-isoprene-styrene), PSIS, treatments is significantly lower than the control which indicates a lower elastic loss and therefore a higher elastic recovery.

Example 17

The investigation of Example 16 was repeated using varying levels of PSBS on the fabric. The areas inside the hysteresis loops are shown in Table 5. A different batch of fabric was used from that used in Example 16 and this gave rise to a different area for untreated fabric.

TABLE 5

Change in Area of the Hysteresis Loops with level of PSBS

| PSBS (% owf) | Area |
|---|---|
| 0 | 0.87 |
| 0.5 | 0.69 |
| 1 | 0.63 |
| 2 | 0.48 |

The data given in Table 5 shows that a lower elastic loss, and therefore a higher elastic recovery, is obtained when the fabric is treated with varying levels of PSBS.

Example 18

Example 17 was repeated using PSBS at a level of 2% owf and knitted cotton fabric in place of woven cotton fabric. The hysteresis loops for a control sample (no treatment) and the sample treated with 2% owf PSBS are shown in FIG. 2. This shows that there is better elastic recovery after treatment of the fabric with PSBS.

Example 19

The effect of PSBS treatment on the wrinkle recovery of woven cotton fabric was investigated. PSBS was applied to the fabric at levels from 0% (control) to 2% owf and the treated samples conditioned as described earlier. The conditioned fabric was cut into 20×30 cm pieces and placed on a Wrinkle Recovery Tester (James Heal & Co. Ltd, UK). The fabric was crushed for 20s with no additional weights applied. The crease intensity was assessed by 10 panellists against AATCC Wrinkle Recovery Replicas. Each sample was repeated 4 times. A higher AATCC score indicates less wrinkles. The results are given in Table 6.

TABLE 6

Effect of PSBS treatment on the wrinkle recovery of cotton fabric

| PSBS (% owf) | AATCC Score |
|---|---|
| 0 | 2.50 |
| 0.5 | 2.64 |
| 1 | 2.87 |
| 2 | 3.02 |

This example shows that as the level of PSBS increases, the wrinkle recovery increases.

Example 20

PSBS was applied to woven cotton fabric at a level of 2% owf in order to investigate the stability of the treated fabric in water.

Samples of the treated fabric were placed in water with agitation for 3 hours. The samples were dried and conditioned, as described above, the hysteresis area was then determined for a control (untreated) fabric and for treated fabric before and after the agitation in water. The results are given in Table 8.

TABLE 8

Effect of wetting PSBS treated fabric on the hysteresis area

| Sample | Area |
|---|---|
| Control | 0.81 |
| PSBS | 0.35 |
| PSBS, wet | 0.32 |

There is no significant change in the hysteresis area showing that the treatment is resistant to water.

Example 21

An investigation was carried out into the effect of treatment with PSBS on the wrinkling of woven cotton fabric during the washing/drying cycle.

Four swatches of printed cotton sheeting (50×50 cm) were cut to size and treated with PSBS at 2% owf. Four similar swatches were cut to size for use as controls. The swatches were washed in a front loading washing machine with 50 g of Persil Non-Biological (trade mark) washing powder. Cotton sheeting was used as ballast to make the total load up to 1.25 kg. The wash load was then dried in a tumble dryer. The washing/drying process was performed a total of three times. At the end of the process (third drying cycle), the swatches were carefully removed from the tumble dryer and placed on a flat surface without smoothing out the fabric. The swatches were then assessed for their relative wrinkling.

The four control swatches had a similar level of severe wrinkling. Three of the PSBS swatches had significantly less wrinkling than the controls and one had similar wrinkling to the controls. Thus, overall, the PSBS treated swatches had significantly less wrinkles after three wash/tumble dry cycles.

Example 22

Woven cotton fabric was treated with a water dispersed thermoplastic elastomer, Prinlin B7216A (trade mark) available from Pierce and Stevens Corp, USA, in place of the solvent soluble PSBS.

The dispersion was diluted in water, applied to the fabric and dried in a tumble dryer. The samples were then ironed (cool: synthetic setting or hot: cotton setting) or heated in an oven (130° C. for 1 hour). The samples were then conditioned and tested for elastic recovery. The results are shown in Table 9.

TABLE 9

Effect of Prinlin ™ with heat treatment on hysteresis area

| Sample | Area |
|---|---|
| Control | 0.96 |
| Cool iron | 0.83 |
| Hot iron | 0.71 |
| Oven | 0.42 |

The data shows that Prinlin (trade mark) has an effect similar to PSBS applied from toluene once the fabric has been heated to a temperature above the glass transition temperature of the hard block of the thermoplastic elastomer.

Example 23

The effect of the treatment of the invention on colour retention after washing/drying cycles was assessed using the samples obtained in Example 21. The printed fabric included regions coloured red and regions coloured black and the colour of each of these two differently coloured regions was investigated separately.

The samples (control and 2% owf PSBS treated) were washed/dried three times. The change in colour was determined as a delta E value (the change in colour from new fabric) using a Spectraflash (trade mark) spectrophotometer. The closer delta E is to zero, the closer the washed sample is to the new fabric. The results are given in Table 10.

TABLE 10

Effect on colour preservation of treatment with PSBS

| Sample | delta B (black) | delta E (red) |
|---|---|---|
| Control | 4.2 | 6.7 |
| PSBS-treated | 4.1 | 5.1 |

The data shows that the PSBS treatment gives a significantly lower delta E value on the red regions and hence improves the appearance of the fabric.

Example 24

The water dispersed thermoplastic elastomer, Prinlin B7138AF (trade mark) available from Pierce and Stevens Corp, USA was diluted to give 2% w/w polymer solids. To this solution was added various levels types of plasticicers at 30% w/w on polymer solids. This solution was applied to fabric (giving 2% polymer on fabric weight) and dried in an oven at 75° C. The samples were then conditioned and tested for elastic recovery in the Bias direction (45° C. to the Warp). The results are shown in table 11.

TABLE 11

Effect of Prinlin ™ with plasticisers on hysteresis area

| SAMPLE | AREA |
|---|---|
| Control (water only) | 0.58 |
| B7138AF + Perfume | 0.44 |
| B7138AT + Xylene | 0.41 |
| B7138AF + Texanol | 0.37 |
| B7138 AF + Propylene Glycol Butyl Ether | 0.44 |
| B7138AF + Benzyl Butyl Phthalate | 0.47 |

Examples 25 and 28

Rinse conditioner formulations were made according to the formulations, in table 12.

TABLE 12

| | Wt. % Example 25 | Example 26 |
|---|---|---|
| Prinlin B 7138 AF | 5.00 | 10.0 |
| Nonionic $C_{12}$–$C_{18}$ 1–10 EO | 0.25 | 0.75 |
| Di(tallowoxyloxy)dimethyl ammonium -chloride | 4.20 | 13.50 |
| Minors + Water | to 100 % | |

What is claimed is:

1. A fabric care composition comprising a solution, dispersion or emulsion comprising a thermoplastic elastomer comprises at least two hard blocks linked by one soft block and a textile compatible carrier comprises a cationic softening agent.

2. A fabric care composition according to claim 1 further comprising a plasticizer.

3. A fabric care composition according to claim 1 further comprising a perfume.

4. The fabric care composition as claimed in claim 1, wherein the elastomer is a block copolymer.

5. The fabric care composition as claimed in claim 1, wherein the hard blocks comprise aromatic rings, optionally substituted.

6. The fabric care composition as claimed in claim 5, wherein the elastomer comprises hard blocks of polymers or copolymers of styrene or derivatives thereof.

7. The fabric care composition as claimed in claim 1 wherein the elastomer comprises soft blocks of polymers or copolymers of branched or unbranched, $C_2$ to $C_6$ alkenes, $C_4$ to $C_8$ alkadienes, $C_2$ to $C_6$ alkylene diols or $C_2$ to $C_8$ alkylene oxides.

8. The fabric care composition as claimed in claim 7, wherein the soft blocks are polymers or copolymers of ethene, propene, butene or butadiene.

9. The fabric care composition as claimed in claim 1 wherein the thermoplastic elastomer is present in an effective amount for increasing surface color definition of treated fabric.

10. The fabric care composition as claimed in claim 1 wherein wherein the thermoplastic elastomer is present in an effective amount for increasing crease recovery properties of treated fabric.

11. The fabric care composition as claimed in claim 1 wherein the thermoplastic elastomer is present in an effective amount for increasing elasticity of treated fabric.

12. The fabric care composition as claimed in claim 1 wherein the thermoplastic elastomer is present in an effective amount for increasing tensile strength of treated fabric.

* * * * *